US012123665B2

(12) United States Patent
Taniguchi et al.

(10) Patent No.: US 12,123,665 B2
(45) Date of Patent: Oct. 22, 2024

(54) HEAT EXCHANGER

(71) Applicant: T.RAD CO., LTD., Tokyo (JP)

(72) Inventors: Yosuke Taniguchi, Tokyo (JP); Ryosuke Maeda, Tokyo (JP)

(73) Assignee: T.RAD CO., LTD., Tokyo (JP)

( * ) Notice: Subject to any disclaimer, the term of this patent is extended or adjusted under 35 U.S.C. 154(b) by 404 days.

(21) Appl. No.: 17/613,488

(22) PCT Filed: Jun. 26, 2020

(86) PCT No.: PCT/IB2020/020032
§ 371 (c)(1),
(2) Date: May 5, 2022

(87) PCT Pub. No.: WO2020/250041
PCT Pub. Date: Dec. 17, 2020

(65) Prior Publication Data

US 2022/0268533 A1 Aug. 25, 2022

(30) Foreign Application Priority Data

Jun. 10, 2019 (JP) ..... 2019-107977

(51) Int. Cl.
*F28F 9/02* (2006.01)
*F28D 21/00* (2006.01)

(52) U.S. Cl.
CPC .... *F28F 9/0246* (2013.01); *F28D 2021/0091* (2013.01); *F28F 2275/04* (2013.01)

(58) Field of Classification Search
CPC ..... F28F 9/0246; F28F 9/0224; F28F 9/0226; F28F 9/028; F28F 9/0221; F28F 2275/04; F28F 2255/00; F28F 2009/226; F28F 2265/02; F28D 2021/0091; F28D 2021/0082; F28D 2021/008; F28D 9/0037; F28D 9/02; F28D 21/0003; F28D 7/1646; F28D 1/05366; F01P 2060/16; F02B 29/0462; F02M 26/32
See application file for complete search history.

(56) References Cited

U.S. PATENT DOCUMENTS

| | | | | |
|---|---|---|---|---|
| 8,925,624 | B2 | 1/2015 | Kuroyanagi et al. | |
| 10,634,431 | B2 | 4/2020 | Shiozawa et al. | |
| 10,724,807 | B2 | 7/2020 | Okubo et al. | |
| 2017/0248371 | A1 | 8/2017 | Garret et al. | |
| 2018/0306527 | A1* | 10/2018 | Okubo | F28F 9/12 |
| 2019/0346211 | A1 | 11/2019 | Asano et al. | |

FOREIGN PATENT DOCUMENTS

| | | | | |
|---|---|---|---|---|
| CN | 106104192 | A * | 11/2016 | F16L 25/0009 |
| CN | 206054089 | U * | 3/2017 | |
| JP | 2-147688 | U1 | 12/1990 | |
| JP | 2005-037037 | A | 2/2005 | |

(Continued)

*Primary Examiner* — Emmanuel E Duke
(74) *Attorney, Agent, or Firm* — Norris McLaughlin, P.A.

(57) ABSTRACT

In cooling/heating cycles of a heat exchanger, to prevent cracks that tend to occur in a brazed portion between an end portion of a horizontal cross-section of a tube and a header plate. An end portion cover body is provided for an end portion of a tank main body or a header to cover hereby an end portion in a longer side direction of an opening end portion of a flat tube.

2 Claims, 3 Drawing Sheets

(56) References Cited

FOREIGN PATENT DOCUMENTS

| | | | | |
|---|---|---|---|---|
| JP | 2005-221151 | A | | 8/2005 |
| JP | 2007-032952 | A | | 2/2007 |
| JP | 2011-232020 | A | | 11/2011 |
| JP | 2013-514513 | A | | 4/2013 |
| JP | 2014055711 | A | * | 3/2014 |
| JP | 2014-163644 | A | | 9/2014 |
| JP | 2018-017415 | A | | 2/2018 |
| JP | 2018-128183 | A | | 8/2018 |
| WO | 2017/069280 | A1 | | 4/2017 |
| WO | 2017/073779 | A1 | | 5/2017 |
| WO | 2019/131569 | A1 | | 7/2019 |
| WO | 2019/189924 | A1 | | 10/2019 |

* cited by examiner

HEAT EXCHANGER

TECHNICAL FIELD

The present invention relates to a reinforcing structure of heat exchangers such as radiators for cooling engine cooling water, charge air coolers and EGR coolers.

BACKGROUND ART

In heat exchangers for cooling engine cooling water, temperature difference is generated between a plurality of flat tubes arranged in parallel and a side plate at an end portion of a heat exchanger, and cracks may be generated in the vicinity of a brazed portion of a tube insertion hole lying at an end portion in a longer side direction of a header plate of the heat exchanger and a brazed portion of a flat tube.

In the same way, also in EGR coolers that cool a high temperature exhaust gas, there is a fault such that cracks tend to occur at an end portion in a longer side direction of an opening end portion of a flat tube.

Conventionally, as a countermeasure, a reinforcing structure of a heat exchanger described in Patent Literature 1 below is known.

In this structure, a planar T-letter shaped portion is formed in an end portion of an opening of a flat tube as a reinforcing member and two insertion portions with an L-letter shaped cross-section are provided for respective front edges of the T-letter. Then, board thickness of the reinforcing member is matched with an opening length in a shorter side direction of the flat tube, and the insertion portion is inserted into an opening edge of the flat tube to be brazed.

CITATION LIST

Patent Literature

PTL 1: Japanese Patent Laid-Open No. 2011-38655

SUMMARY OF INVENTION

Technical Problem

The reinforcing structure of a conventional heat exchanger requires an additional reinforcing member and a brazing process of these, which is troublesome.

Accordingly, the present invention is directed to provide a heat exchanger that does not require an additional reinforcing member and can be assembled easily.

Solution to Problem

The present invention according to a first aspect is a heat exchanger, including:

a header plate 3, in which major axis directions of a plurality of flat holes 1 are disposed along a shorter side direction of the header plate 3, respective flat holes 1 are arranged in parallel separately at regular intervals in a longer side direction of the header plate 3, an opening end portion 2*a* of a flat tube 2 is inserted into the respective flat holes 1 while positioning a longer side direction thereof in a shorter side direction of the header plate 3, and the insertion portion is brazed; and a tank main body 4 with which a peripheral border of the header plate 3 is connected, and the tank main body 4 supplying a high temperature fluid 6 into the respective flat tubes 2, in which:

an end portion cover body 5 that covers at least one end portion in a longer side direction L of the opening end portion 2*a* is constituted integrally with the tank main body 4, lying at at least one end portion in a longer side direction of the header plate 3 and at at least one end portion in the longer side direction L of the opening end portion 2*a* of the flat tube 2.

The present invention according to a second aspect is a heat exchanger, in which a pair of plates formed in a groove shape constitute a flat tube 15 while facing groove bottom portions thereof, the flat tube 15 has a protruding portion 15*a* in a vertical direction to the groove bottom portion at an opening end portion, a plurality of the flat tubes 15 are stacked at the protruding portion 15*a* to form a core 13, an outer circumference of the core 13 is covered with a casing 9, a header 14 is provided for an end portion of the casing 9, and a high temperature fluid 6 is supplied into respective flat tubes 15 from the header 14 and a cooling water 10 is guided to an outer circumference of the flat tube 15, in which:

an end portion cover body 5, which covers an end portion on the core 13 side and an end portion in a longer side direction L of an opening end portion 15*b* of the flat tube 15, is constituted integrally with the header 14, and at an end portion on the core 13 side of the header 14 and at at least one end portion position in the longer side direction L of the opening end portion 15*b* of the flat tube 15.

Advantageous Effects of Invention

In the heat exchanger according to the first aspect of the invention, the end portion cover body 5, which covers at least one end portion in the longer side direction L of the opening end portion 2*a* of the flat tube 2, is formed integrally with the tank main body 4, lying at at least one end portion in the longer side direction of the header plate 3 and at at least one end portion in the longer side direction L of the opening end portion 2*a* of the flat tube 2.

This end portion cover body 5 covers at least one end portion of the opening end portion 2*a* of the flat tube 2 to suppress circulation of the high temperature fluid 6 therein. Hereby, there is an effect of protecting the end portion in the longer side direction L of the opening end portion 2*a* of the flat tube 2 where cracks tend to occur due to thermal strain to improve durability of the heat exchanger. In other words, thermal strain due to cooling/heating cycles of operation/stop of the heat exchanger can be reduced effectively.

In the heat exchanger according to the second aspect of the invention, the core 13 of interest is constituted of a stacked body of the flat tube 15 having the protruding portion 15*a* at the opening end portion, where the end portion cover body 5 is provided at at least one end portion on the core 13 side of the header 14.

Also in this instance, similar to that in the first aspect of the invention, at least one end portion in the longer side direction L of the opening end portion 15*b* of the flat tube 15 is covered with the end portion cover body 5 lying at the end portion on the core 13 side of the header 14 to suppress circulation of the high temperature fluid 6 therein. Accordingly, thermal strain due to cooling/heating cycles of operation/stop of the heat exchanger can be reduced effectively.

BRIEF DESCRIPTION OF DRAWINGS

FIGS. 1A and 1B illustrate the heat exchanger of the present invention, in which FIG. 1A is a main portion vertical cross-sectional view and a cross-sectional view seen along an A-A arrow in FIG. 1B, and FIG. 1B is a plan view of a horizontal cross-section thereof and is a cross-sectional view seen along a B-B arrow in FIG. 1A.

FIGS. 3A and 3B illustrate a second Example of the present invention, in which FIG. 3A is a main portion vertical cross-sectional view, and FIG. 3B is a perspective view of the core 13 thereof.

DESCRIPTION OF EMBODIMENTS

Next, embodiments of the present invention will be explained on the basis of the drawings.

Example 1

Figure 1A:
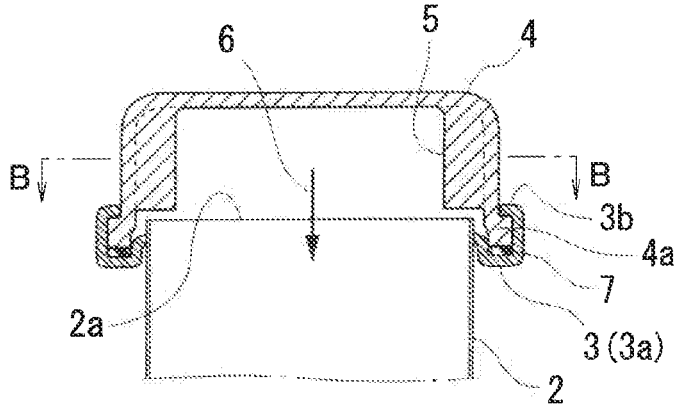
Figure 1B:
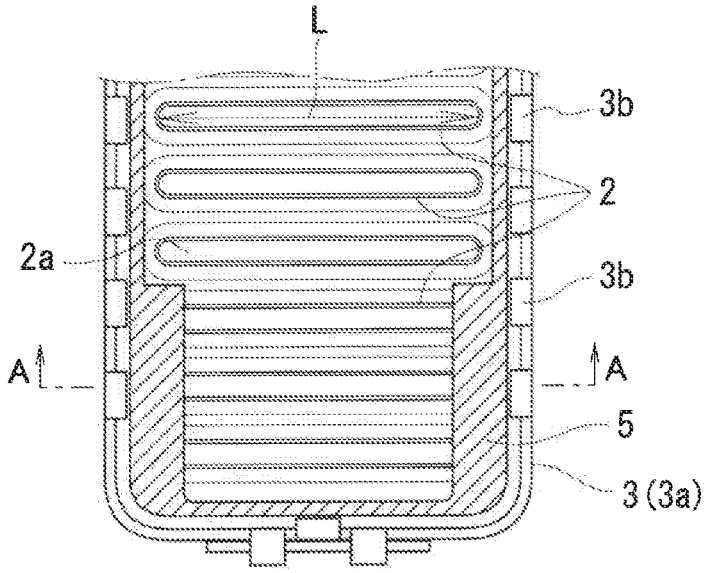
Figure 2:
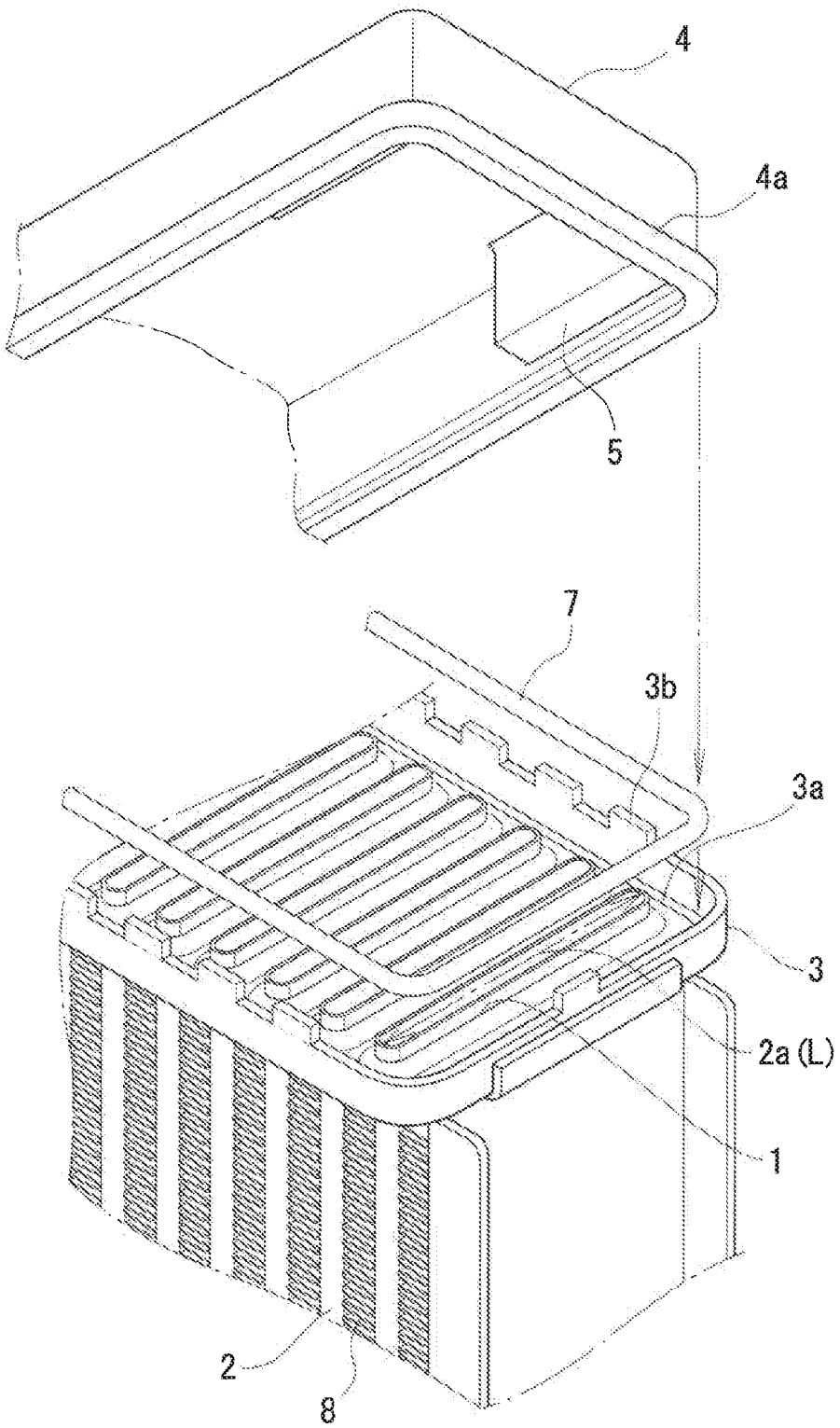
FIG. 2 illustrates an exploded perspective view of the heat exchanger.

FIGS. 1A and 1B and FIG. 2 illustrate a heat exchanger in a first Example of the present invention, which is for use, as an example, in a radiator for cooling an engine cooling water.

FIGS. 1A and 1B illustrate a vertical cross-sectional view thereof and a cross-sectional view seen along the B-B arrow in FIG. 1A, and FIG. 2 illustrates a main portion exploded view of the heat exchanger.

This heat exchanger can be used as a radiator that cools an engine cooling water, in which a flat tube 2 and a corrugated fin 8 are arranged alternately in parallel to form a core and a side plate is disposed at an end portion in a longer side direction of a header plate of the core.

In respective flat tubes 2, a horizontal cross-section is formed to be flat, a longer side direction L of the horizontal cross-section thereof is disposed in a shorter side direction of the header plate of the heat exchanger. Furthermore, both end portions (lower side is omitted) of respective flat tubes 2 are inserted into respective flat holes 1 of a header plate 3, and the insertion portion is brazed and fixed.

In the header plate 3, as shown in FIG. 1A and FIG. 2, an annular groove 3*a* is formed on a peripheral border, and engaging claws 3*b* are provided in a protruding condition at regular intervals on the peripheral border. To the annular groove 3*a* of this header plate 3, a small flange portion 4*a* of a tank main body 4 is fitted via a seal 7.

The tank main body 4 is formed from a resin, in this example. On an outer periphery thereof, the small flange portion 4*a* is provided in a protruding condition, and an end portion cover body 5 is provided integrally in a protruding condition on an internal face of an end portion in a longer side direction of the tank main body 4. Thickness of the end portion cover body 5 is, as shown in FIG. 1A, a sufficient thickness for covering the end portion in the longer side direction L of the opening end portion 2*a* of the flat tube 2 as in FIG. 1B.

Meanwhile, in this example, there is a narrow space between the end edge on a flat tube 2 side of the end portion cover body 5 and the opening end portion 2*a* of the flat tube 2. Furthermore, as shown in FIG. 1B, the end portion cover body 5 is formed in an end portion in the longer side direction of the header plate 3 and end portions in the longer side direction L of the opening end portions 2*a* of the flat tubes 2.

In FIG. 1B, only one end portion in the longer side direction of the header plate 3 is represented, but the other end portion may be formed in the same way.

Then the small flange portion 4*a* of the tank main body 4 is fitted to the annular groove 3*a* of the header plate 3 via the seal 7, and the engaging claw 3*b* of the header plate 3 is caulked to the exterior surface side of the tank main body 4 to form a liquid-tight structure.

Action

In the heat exchanger constituted as described above, a high temperature fluid 6 is guided into the tank main body 4 from an inlet (not shown) of the tank main body 4. Then, the high temperature fluid 6 is supplied to respective flat tubes 2, performs heat exchange with an air flow circulating along the exterior surface of the flat tube 2 and the corrugated fin 8, and is returned to an engine block from a tank (not shown) on the lower end side.

Heat is transferred to a side plate disposed to the end portion in the longer side direction of the header plate 3 of the core from the flat tube 2 via the corrugated fin 8 joined to the side plate, but increased temperature in the side plate is lower and increase rate is also lower as compared with temperature increase in the flat tube 2.

Difference in thermal expansions due to difference in temperatures in the side plate and the flat tube 2 generates thermal strain in the header plate 3, and, since board thickness of the flat tube 2 is thinner than board thicknesses of the side plate and header plate 3, thermal stress concentrates and cracks tend to occur at the end portion in the longer side direction L of the opening end portion of the flat tube 2, in a brazed portion between the header plate 3 and the flat tube 2 lying at the end portion in the longer side direction of the header plate.

On this occasion, in the tank main body 4 on an inlet side, the end portion cover body 5 exists in a position of the end portion in the longer side direction L of the opening end portion of the flat tube 2, and therefore in FIG. 1B, in this example, end portions in the longer side direction L of the opening end portions 2*a* of three flat tubes 2 in the end portion are covered, a cooling water at comparatively high temperatures hardly flows into this end portion, and a flow volume of the high temperature cooling water also decreases as compared with flat tubes 2 in other positions. Therefore, less temperature rise in the flat tube 2 lying at the end portion in a longer side direction of the header plate 3 can prevent effectively cracks due to thermal strain that tends to occur at the end portion in the longer side direction L of the opening end portion 2*a* of the flat tube 2.

In other words, in heat exchangers, thermal strain is generated in a tube due to operation/stop cycles thereof, and it is generated notably at the end portion in the longer side direction L of the opening end portion 2*a* of the flat tube 2 in particular. In the inside of a tank, it is generated more intensively at an end portion in the longer side direction of the header plate 3.

In the present invention, the section is covered with the end portion cover body 5, and therefore cracks due to thermal strain can be made as small as possible.

In addition, in this example, cracks are prevented with the end portion cover body 5 integrated with the tank main body 4, and therefore the heat exchanger is easily assembled and requires a small number of parts to lead to high mass productivity.

Example 2

Figure 3A:
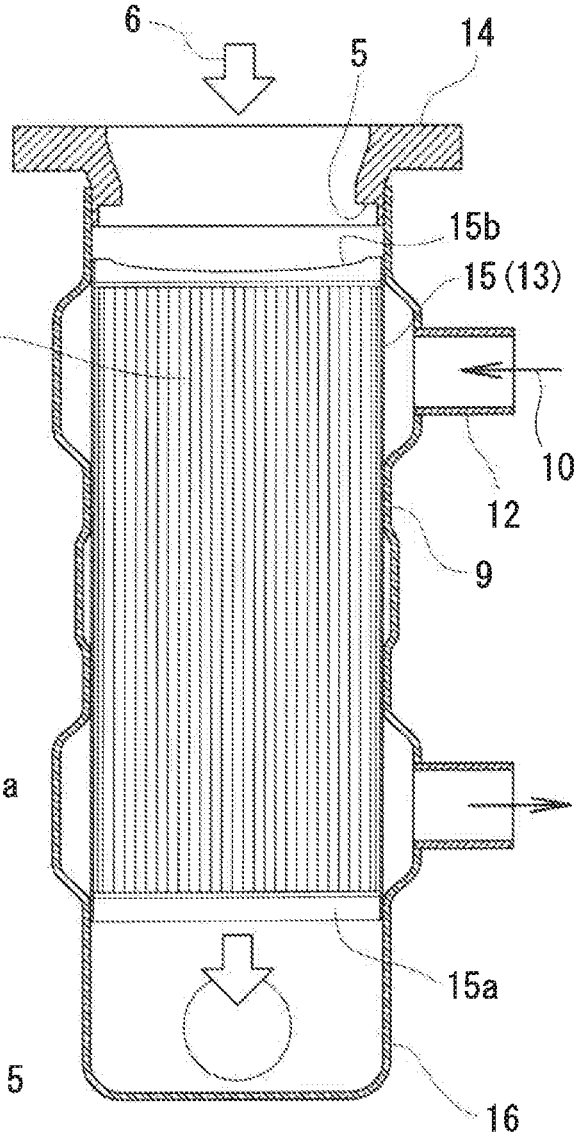
Figure 3B:
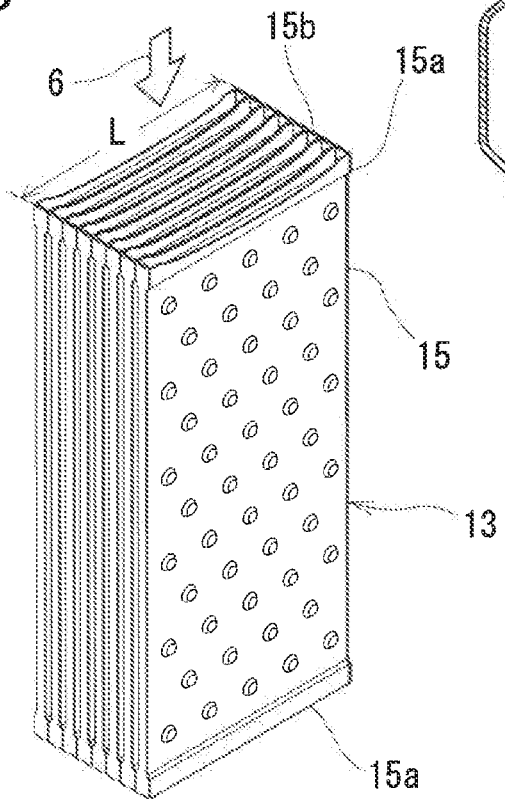

Next, FIGS. 3A and 3B illustrate a second Example of the present invention, in which FIG. 3A illustrates a vertical cross-sectional view thereof, and FIG. 3B illustrates a schematic perspective view of the core 13 accommodated in the inside thereof.

This example can be used as an EGR cooler that cools a high temperature exhaust gas.

In this example, a pair of plates are used, in which the plate is formed in a groove shape and the protruding portions 15*a* are formed at both end portions of a groove bottom portion plane in the vertical direction to the groove bottom portion, and groove bottom portions of respective plates are faced and fitted to form the flat tube 15. Then respective flat tubes 15 are stacked at the protruding portions 15*a* to form the core 13. Additionally, an outer circumference of the core 13 is covered with a casing 9, and the header 14 is disposed to one end thereof and a tank portion 16 is disposed to the other end. A pair of pipes 12 are provided in a protruding condition for both end portions of the casing 9 in a direction connecting two opening end portions 15*b* of the flat tube 15 to supply a cooling water 10 to the outer circumference of respective flat tubes 15. With this, the high temperature fluid 6 is supplied into respective flat tubes 15 from the header 14, and heat exchange is performed between the cooling water 10 and the high temperature fluid 6.

In this example, the end portion cover body 5 is provided in a protruding condition integrally with the header 14, and, with that, the end portion in the longer side direction L of the opening end portion 15*b* of the flat tube 15 is covered.

In other words, it is constituted so that the high temperature fluid 6 is not guided to the end portions in the longer side direction L of the opening end portions 15*b* of respective flat tubes 15. Thus, temperature rise at the end portions in the longer side direction L of the opening end portions 15*b* of the flat tubes 15 is suppressed to prevent cracks as far as possible, which tend to occur relative to the casing 9 going with cooling/heating cycles.

Also in this example, the end portion cover body 5 may be disposed only to the end portion in a tube stacking direction of the tank (header), as in FIG. 1B. Alternatively, the end portion cover body 5 may be disposed in the whole region in the tube stacking direction of the header.

Meanwhile, in this example, front-end edges of the opening end portions 15*b* of respective flat tubes 15 bend slightly toward a tank portion 16 side, which absorbs thermal strain.

In addition, in respective flat tubes 15, an inner fin 11 is placed.

REFERENCE SIGNS LIST

1: flat hole
2: flat tube
2*a*: opening end portion
3: header plate
3*a*: annular groove
3*b*: engaging claw
4: tank main body
4*a*: small flange portion
5: end portion cover body
6: high temperature fluid
7: seal
8: corrugated fin
9: casing
10: cooling water
11: inner fin
12: pipe
13: core
14: header
15: flat tube
15*a*: portion
15*b*: opening end portion
16: tank portion
L: longer side direction of opening end portion of flat tube.

The invention claimed is:

1. A heat exchanger, comprising:

a header plate, in which major axis directions of a plurality of flat holes are disposed along a shorter side direction of the header plate, respective flat holes are arranged in parallel separately at regular intervals in a longer side direction of the header plate, an opening end portion of a flat tube is inserted into the respective flat holes while positioning a longer side direction thereof in a shorter side direction of the header plate, and the insertion portion is brazed; and a tank main body with which a peripheral border of the header plate is connected, and the tank main body supplying a high temperature fluid into the respective flat tubes, wherein:

an end portion cover body that covers at least one end portion in a longer side direction of the opening end portion of the flat tube is constituted integrally with the tank main body and lies only at one end portion or both end portions in a longer side direction of the header plate, in which direction the flat tubes are stacked in the header plate, the end portion cover body being configured so as to constrict the opening of each of the opening end portions which it covers so as to decrease flow of fluid through each of the tubes the opening end portion of which is covered by the end portion cover body.

2. A heat exchanger, in which a pair of plates formed in a groove shape constitute a flat tube while facing groove bottom portions, the flat tube has a protruding portion in a vertical direction to the groove bottom portion at an opening end portion, a plurality of the flat tubes are stacked at the protruding portion to form a core, an outer circumference of the core is covered with a casing, a header is provided for an end portion of the casing, and a high temperature fluid is supplied into respective flat tubes from the header and a cooling water is guided to an outer circumference of the flat tube, wherein:

an end portion cover body on the core side of the header, which covers at least one end portion in a longer side direction of an opening end portion of the flat tube, is constituted integrally with the header and lies at only one end portion or both end portions of the core in a direction orthogonal to the longer side direction of the opening end portion of the flat tube, in which direction the flat tubes are stacked in the header plate, the end portion cover body being configured so as to constrict the opening of each of the opening end portions which it covers so as to decrease flow of fluid through each of the tubes the opening end portion of which is covered by the end portion cover body.

* * * * *